US006461246B1

(12) United States Patent
Lee et al.

(10) Patent No.: US 6,461,246 B1
(45) Date of Patent: Oct. 8, 2002

(54) DEVICE FOR PUTT-PRACTICE

(75) Inventors: Dong-Min Lee, Kyunggi-do; Bum-Jae Lee, Incheon-shi, both of (KR)

(73) Assignee: KGP Co., Ltd., Seoul (KR)

( * ) Notice: Subject to any disclaimer, the term of this patent is extended or adjusted under 35 U.S.C. 154(b) by 0 days.

(21) Appl. No.: 09/947,219

(22) Filed: Sep. 4, 2001

(30) Foreign Application Priority Data

Sep. 2, 2000 (KR) ..... 00-51851

(51) Int. Cl.[7] ..... A63B 67/02; A63B 69/36

(52) U.S. Cl. ..... 473/151; 473/261; 473/265; 473/221

(58) Field of Search ..... 473/151, 221, 473/257, 261–265, 218–222, 150, 152, 155, 190, 225, 278

(56) References Cited

U.S. PATENT DOCUMENTS 4,437,669 A * 3/1984 Pelz ..... 473/265
4,872,687 A * 10/1989 Dooley ..... 473/152
5,301,947 A * 4/1994 Kim ..... 473/153
5,332,211 A * 7/1994 Rife et al. ..... 273/DIG. 21
5,435,547 A * 7/1995 Lee ..... 473/221
5,551,695 A * 9/1996 Wolk ..... 473/236
5,595,543 A * 1/1997 Wolk ..... 473/162
5,692,966 A * 12/1997 Wash ..... 473/180
5,733,200 A * 3/1998 Kim ..... 473/153
6,042,483 A * 3/2000 Katayama ..... 473/152
6,146,283 A * 11/2000 Ferguson, III ..... 473/140
2002/0022530 A1 * 2/2002 Yoon ..... 473/150

* cited by examiner

*Primary Examiner*—Jessica Harrison
*Assistant Examiner*—Alex F. R. P. Rada, II
(74) *Attorney, Agent, or Firm*—Sierra Patent Group, Ltd.

(57) ABSTRACT

A device for putt-practice is disclosed. This device has a first casing opened at its opposite ends, with a speed sensor provided at each end of the first casing and a ball inlet formed at one end of the first casing. A second casing, opened at its opposite ends, is axially connected to an end of the first casing, with a transparent window provided at the upper portion of the second casing for guiding a backstroke movement of a putter during an act of putting. This second casing also has a displaying means for displaying a target putting distance preset by a user, a practical backstroke distance of the putter, and putting results after the act of putting.

8 Claims, 4 Drawing Sheets

DEVICE FOR PUTT-PRACTICE

PRIORITY CLAIMED

This application claims the benefit of Korean Application number 2000-51851. This application claims priority of Korean Patent Application No. 2000-51851 which was filed on Sep. 2, 2000.

BACKGROUND OF THE INVENTION

1. Field of the Invention

The present invention relates, in general, to a device for putt-practice and, more particularly, to a putt-practicing device allowing a user to preset a target putting distance, and sensing the backstroke distance of a putter during an act of putting in accordance with the preset putting distance, thus allowing the user to putt with a precisely backstroke of a putter, the device also sensing the moving velocity of the putted ball during the act of putting to convert the sensed moving velocity into a moving distance of the putted ball prior to informing the user of the moving distance, thereby allowing the user to practice the putting while appropriately changing his/her putting strength in accordance with desired putting distances.

2. Description of the Prior Art

While golfing, it is very important to precisely putt a ball on a green so as to make the ball roll along the green into the hole, in addition to precisely driving the ball to position it on the green using a wood or an iron.

Different from being shown at first sight, the typical greens of golf courses consist of sloping areas and curved areas, and so it is necessary for golfers to carefully putt balls on the green while precisely controlling their putting strengths in consideration of the sloping angles and curved angles of the green, a distance between the ball and the hole, and the height of grasses.

Of the conditions necessarily considered while putting, the putting strength is the most important factor. In order to precisely control the putting strength, it is necessary for a golfer to primarily, precisely calculate the distance between the hole and the ball and control his/her putting strength by precisely performing the backstroke of a putter in accordance with the calculated distance.

Since the putting requires high precision as described above, it is necessary for golfers to repeatedly practice the putting. Most golfers thus purchase indoor putt-practicing devices, and install the devices to easily practice the putting.

The conventional putt-practicing devices typically comprise a mattress laid along the top surface of a base board having a predetermined length, with a guide rail provided along each side of the board for preventing an undesired removal of balls from the board and a hole cup installed at one end of the board to act as the hole of a green. Due to the construction of the conventional putt-practicing devices, the devices only allow users to make themselves familiar with putting stance, but do not allow the users to practice the control of their putting strengths according to target putting distances.

In an effort to overcome the above-mentioned problems, a putt-practicing device designed to sense the hitting strength while putting so as to allow a user to practice the control of putting strength in accordance with target putting distances was proposed in Korean Utility Model Registration No. 152039 (Utility Model Publication No. 1997-53602).

As shown in FIG. 1, the Korean putt-practicing device 100 comprises a lower panel 110, which seats a putting hole unit 112 thereon. The putting hole unit 112 consists of a flat surface 111, opposite sidewalls 113 standing upright along the opposite side edges of the flat surface 111, and a target plate 114 extending between the two sidewalls 113, with a ball guide channel 115 extending from the putting hole unit 112 to a predetermined position on the lower panel 110. The top of the lower panel 110 is covered with an upper casing 120, which has a ball inlet 121, a digital putting distance display 123, and a ball outlet 122. The putt-practicing device 100 also has a sloping member 130, which is mounted to the external surface of the upper casing 120 at a position under the ball inlet 121 by means of two insert pieces 131.

In order to practice putting using the above device 100, a user lays a ball on a ball start mark formed on the mattress, and putts the ball using a putter, The ball thus rolls along the inclined surface of the sloping member 130, and passes through the ball inlet 121 so as to hit and impact the target plate 114 of the putting hole unit 112.

When the target plate 114 is impacted by the putted ball as described above, the device generates a melody. In such a case, an impact sensor of the target plate 114 senses the impact strength of the ball applied to the target plate 114 and converts the impact strength into a distance. The distance is digitized and displayed on the digital distance display 123 of the upper casing 120, thus allowing the user to easily confirm his. putting strength.

The above putt-practicing device 100 is advantageous in that the target plate 114 is installed at the putting hole unit 112, and senses the impact strength of a putted ball at its impact sensor, and converts the impact strength into a distance prior to displaying the digitized distance on the digital distance display 123 of the upper casing 120, thus allowing a user to easily confirm his putting strength.

Since the target plate 114 is installed on the lower panel 110 at a position inside the ball inlet 121 of the upper casing 120, it is necessary for the putted balls to inevitably pass through the ball inlet 121 prior to impacting the target plate 114. However, the size of the ball inlet 121 is too small for the users to putt the balls to pass the balls through the inlet 121 while practicing the putting.

Therefore, when a putted ball fails to pass through the ball inlet 121, the ball does not impact the target plate 114 of the putting hole unit 112, and so the target plate 114 cannot sense the impact strength of the putted ball.

The above putt-practicing device is thus problematic in that it is only effectively used by highly-skilled golfers, such as professional golfers, but may be not effectively used by middle- or lowly-skilled golfers.

Another problem experienced in the above Korean putt-practicing device resides in that it is not used for measuring the backstroke distance of a putter while putt-practicing, and so the device is not used for practicing the control of putting strength of a user.

SUMMARY OF THE INVENTION

Accordingly, the present invention has been made keeping in mind the above problems occurring in the prior art, and an object of the present invention is to provide a device for putt-practice, which allows a user to preset a desired putting distance, and senses the backstroke distance of a putter during an act of putting in accordance with the preset putting distance, thus allowing the user to putt with a precise backstroke of the putter, and which senses the moving velocity of a putted ball during the act of putting to convert the sensed moving velocity into a moving distance of the putted ball prior to informing the user of the moving distance of the ball, thereby allowing the user to practice the putting while appropriately changing his/her putting strength in accordance with target putting distances.

Another object of the present invention is to provide a device for putt-practice, which has a foothold at a side thereof, with foot marks provided on the foothold for allowing a user to putt while appropriately changing his/her stance in accordance with a preset target putting distance, thus allowing the user to practice his/her putting stance in accordance with a desired putting distance.

In order to accomplish the above object, the present invention provides a device for putt-practice, comprising: a first casing having a predetermined length and being opened at its-opposite ends, with a speed sensor provided at each end of the first casing and a ball inlet formed at one end of the first casing; and a second casing opened at its opposite ends and axially connected to an end of the first casing, with a transparent window provided at the upper portion of the second casing for guiding a backstroke movement of a putter during an act of putting, the second casing also having a displaying means for displaying a target putting distance preset by a user, a practical backstroke distance of the putter, and putting results after the act of putting.

In the device, a plurality of notch-marks, each having a sensor, are formed on the transparent window of the second casing.

The displaying means of the second casing comprises: a distance-setting button allowing the user to preset the target putting distance; a display window displaying the preset target putting distance and the practical backstroke distance of the putter; and a signal generator comparing the preset target putting distance with the practical backstroke distance, sensing a moving velocity of the putted ball during the act of putting, and converting the sensed moving velocity of the ball into a distance prior to generating a voice signal in the form of cheerful melody or alarm voice to inform the user of the putting results after the act of putting.

The device of this invention thus allows the user to perform a backstroke movement of the putter in accordance with the preset target putting distance, and senses the moving velocity of the putted ball to convert the moving velocity into a distance prior to informing the user of the moving distance. Therefore, the user practices the act of putting using the device of this invention while changing his/her putting strength in accordance with the target putting distance.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
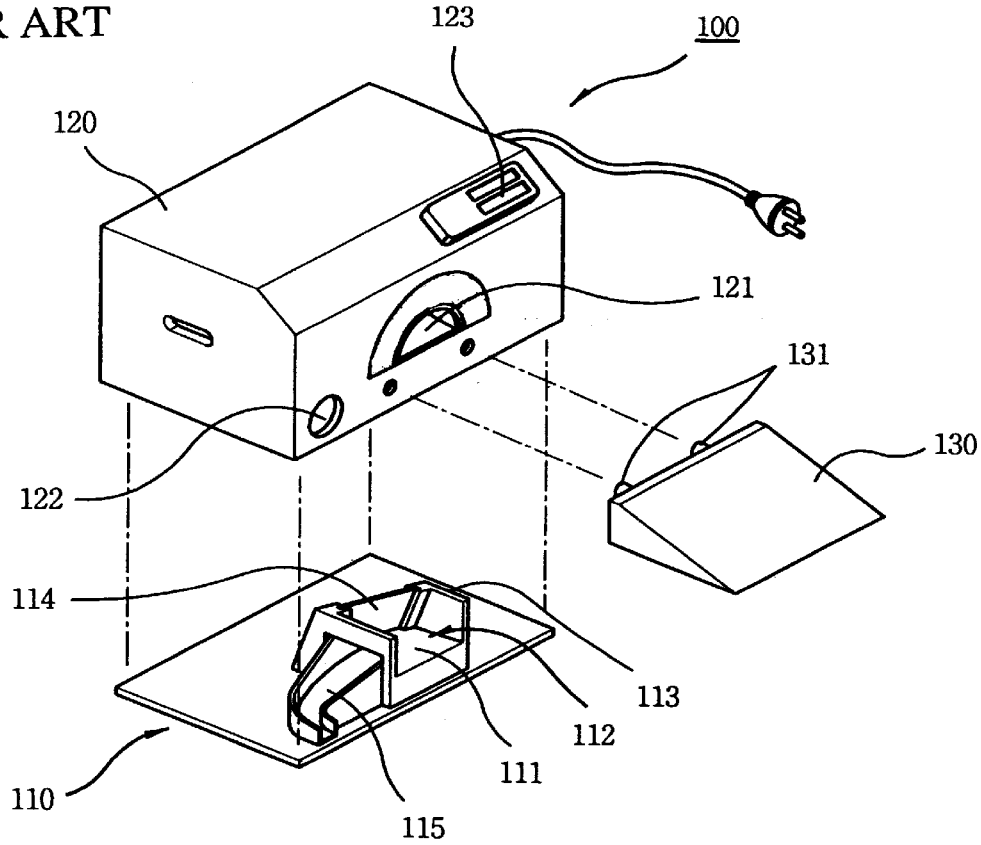
FIG. 1 PRIOR ART
FIG. 1 is an exploded perspective view of a conventional putt-practicing device.

Reference now should be made to the drawings, in which the same reference numerals are used throughout the different drawings to designate the same or similar components.

Figure 2:
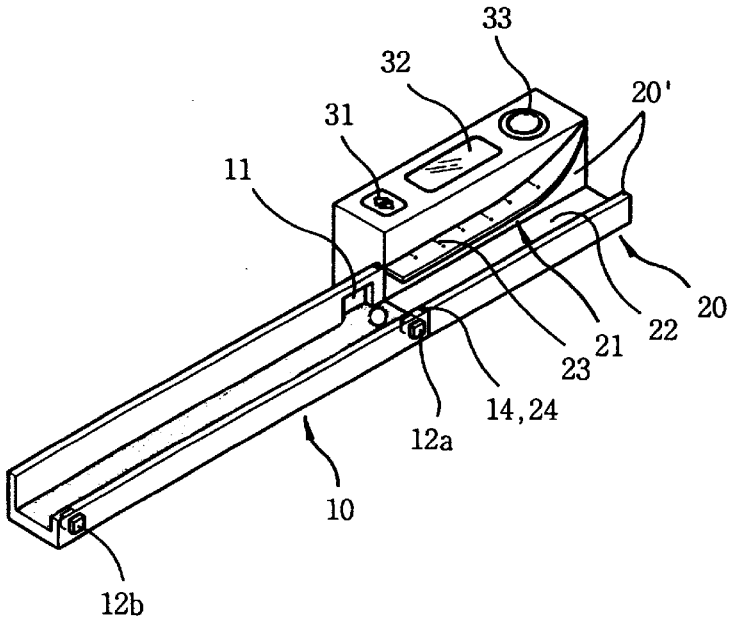
FIG. 2 is a perspective view of a putt-practicing device in accordance with the primary embodiment of the present invention.
Figure 3:
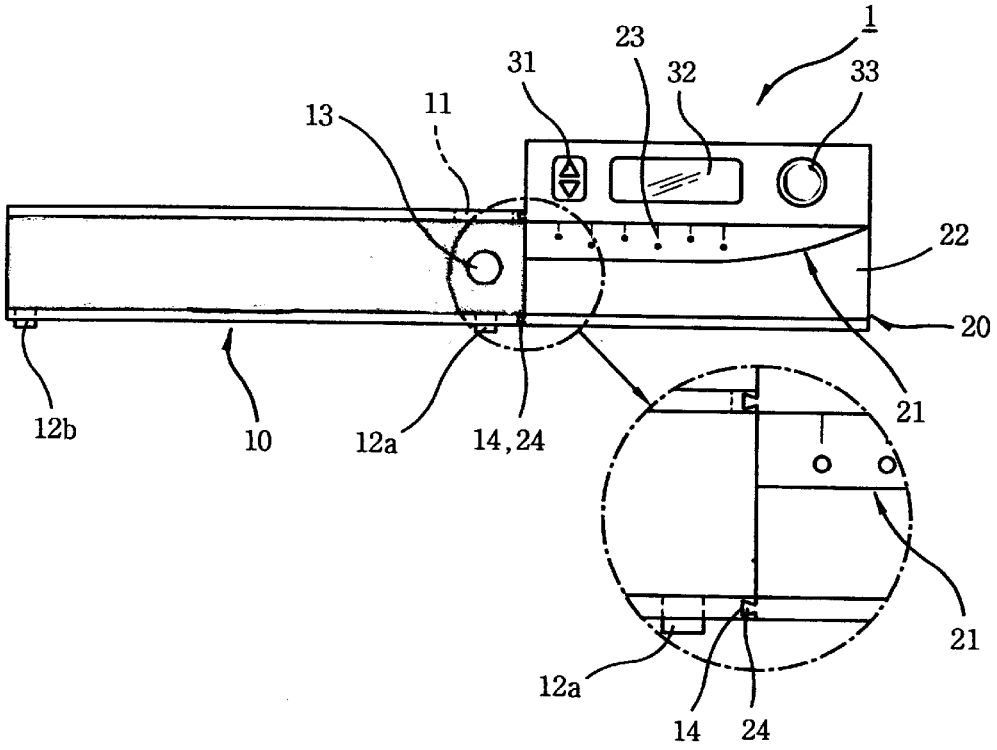
FIG. 3 is a plan view of the putt-practicing device in accordance with the primary embodiment of this invention.

FIG. 2 is a perspective view of a putt-practicing device in accordance with the primary embodiment of the present invention. FIG. 3 is a plan view of the putt-practicing device of this invention.

As shown in the drawings, the putt-practicing device 1 of the present invention comprises a longitudinal channel-type first casing 10, which has a U-shaped cross-section and is opened at its opposite ends. A speed sensor 12*a*, 12*b* is provided at each of the first and second ends of the casing 10, while a ball inlet 11 is formed at the first end of the casing at a position around the first speed sensor 12*a*.

A conventional artificial lawn is laid on the top surface of the bottom of the casing 10, with a start mark 13 provided on the first end of the casing 10 with the ball inlet 11.

The two speed sensors 12*a* and 12*b*, provided at the opposite ends of the casing 10, are used for sensing the moving speed of a putted ball when the ball passes by the sensors 12*a* and 12*b*. That is, the two sensors 12*a* and 12*b* sense the moving velocity of the putted ball passing by the sensors 12*a* and 12*b*, and measure the time the ball moves from the start point to the last point of the casing 10, and measure the putted strength of the ball.

A second casing 20 longitudinally extends from the first end of the first casing 10 to a predetermined length. Two sidewalls 20' are formed along the opposite sides of the second casing 20. The opposite ends of the second casing 20 are opened, with a transparent window 21 provided on one sidewall of the second casing 20 to be positioned at the upper portion of the casing 20 and used for guiding a backstroke movement of a putter during an act of putting.

The transparent window 21, provided at the upper portion of the second casing 20 for preventing a putter from being excessively quickly swung upward during a backstroke movement of the putter, is spaced apart from the bottom surface of the second casing 20. A space 22 is thus formed between the window 21 and the bottom surface of the casing 20. In such a case, the first end part of the window 21 extends in parallel to the bottom surface of the casing 20, while the second end part of the window 21 is gently curved upward so as to allow a putter to smoothly move through the space 22 without being interfered with the window 21 during a backstroke movement of the putter.

In addition, the two sidewalls 20' prevent an undesired lateral movement of a putter during a backstroke movement, and so the sidewalls 20' precisely guide the putter to allow a user to precisely putt a ball.

A plurality of notch-marks 23, each having a sensor, are formed on the transparent window 21, thus sensing a backstroke distance of a putter during a backstroke movement of the putter.

Since the object of the putt-practicing device according to this invention is to allow a user to control his/her putting strength in accordance with a desired putting distance, the width of the longitudinally connected first and second casings 10 and 20 is set to allow a putter to move without being interfered with the casings 10 and 20. Preferably, the width of the first and second casings 10 and 20 is set to 20~25 cm in consideration of the width of the heads of putters, and so it is possible to reduce the size of the putt-practicing device of this invention and save the. installation area of the putt-practicing device.

In order to allow a detachable connection of the first and second casings 10 and 20 into a single body, a plurality of locking holes 14 and locking projections 24 are formed at the facing ends of the casings 10 and 20. It is thus possible to easily assemble and disassemble the casings 10 and 20 as desired.

A displaying means is provided around the second casing 20 for displaying a target putting distance preset by a user, and a practical backstroke distance of a putter sensed by the sensors of the notch-marks 23 of the transparent window 21 during a backstroke movement of the putter, in addition to informing the user of the putting results after a putting action.

The displaying means comprises a distance-setting button 31, a display window 32 and a voice signal generator 33. The distance-setting button 31 allows a user to preset a target putting distance. The display window 32 displays the preset target putting distance and a practical backstroke distance during a backstroke movement of a putter. The voice signal generator 33 compares the preset target putting distance with the practical backstroke distance during the backstroke movement of the putter prior to generating a cheerful melody signal or an alarm voice signal. The signal generator 33 also senses a moving velocity of a putted ball during an act of putting, and converts the sensed moving velocity into a distance prior to generating a voice signal in the form of cheerful melody or alarm voice to inform the user of the putting results after a putting action.

When it is desired to practice a putting action using the device of this invention while changing the putting strength in accordance with desired putting distances, a ball is primarily laid on the start mark 13 of the first casing 10. Thereafter, a user sets a target putting distance by manipulating the distance-setting button 31 of the displaying means prior to confirming the preset target putting distance through the display window 32.

Thereafter, the user putts the ball laid on the start mark 13 of the first casing 10. The ball thus passes through the first casing 10 so as to be discharged from the first casing 10 through the second end of the casing 10.

When putting the ball, the user performs a backstroke of the putter prior to hitting the ball. During the backstroke movement of the putter, the sensors of the notch-marks 23 formed on the transparent window 21 sense the backstroke distance of the putter. The signal generator 33 compares the target putting distance, preset by the button 31 and displayed on. the display window 32, with the practical backstroke distance during the backstroke movement of the putter, and generates a voice signal in the form of cheerful melody or alarm voice to inform the user of success or failure of the backstroke action.

Figure 4A:
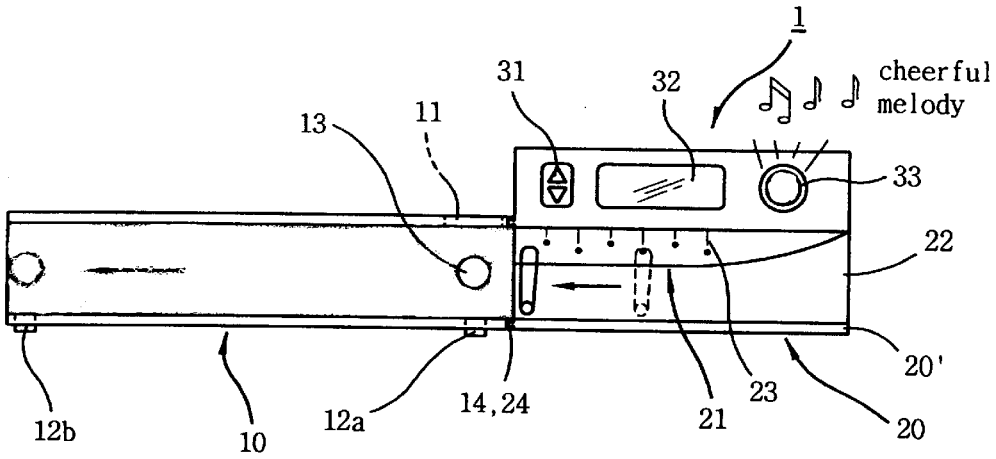
FIGS. 4*a* and 4*b* are plan views showing the operational effect of the putt-practicing device according to the primary embodiment of this invention.
Figure 4B:
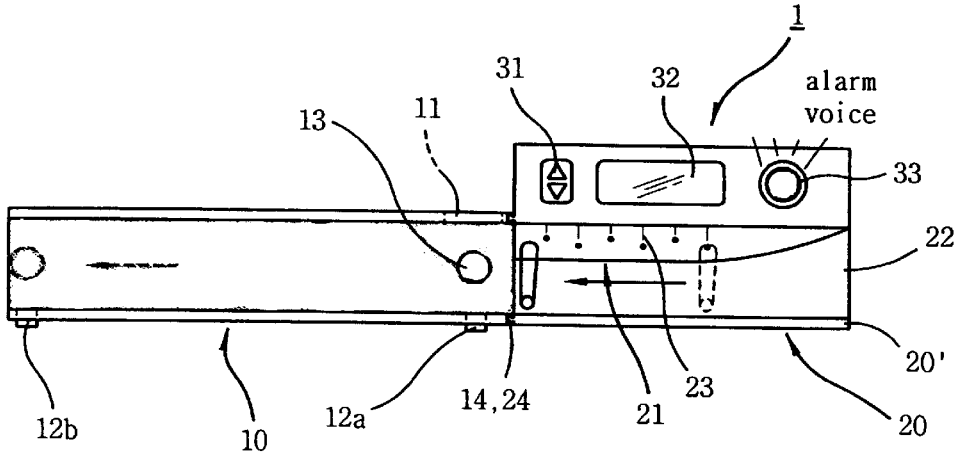

That is, when the practical backstroke distance of the putter sensed by the sensors of the notch-marks 23 and displayed on the display window 32 is equal to the target putting distance preset using the distance-setting button 31 and displayed on the display window 32, the signal generator 33 generates a cheerful melody signal as shown in FIG. 4*a*. On the other hand, when the practical backstroke distance of the putter is not equal to the target putting distance, the signal generator 33 generates an alarm voice signal, such as screech, as shown in FIG. 4*b* so as to alarm the user of the difference between the practical backstroke distance and the target putting distance.

When the backstroke distance of the putter sensed by the sensors of the notch-marks 23 is equal to the target putting distance preset by the distance-setting button 31 and displayed on the display window 32, the user putts the ball laid on the start mark 13.

When the putted ball passes by the first and second speed sensors 12*a* and 12*b*, the two sensors 12*a* and 12*b* sense the moving velocity of the ball and convert the moving velocity of the ball into a distance prior to displaying the distance on the display window 32. When the practical putting distance is equal to the target putting distance, the signal generator 33 generates a cheerful melody to celebrate a good putting action of the user and allows the user to repeatedly perform the good putting action.

However, when the practical putting distance is not equal to the target putting distance, the signal generator 33 generates an alarm voice signal, such as screech, to alarm the user of a bad putting action.

Figure 5:
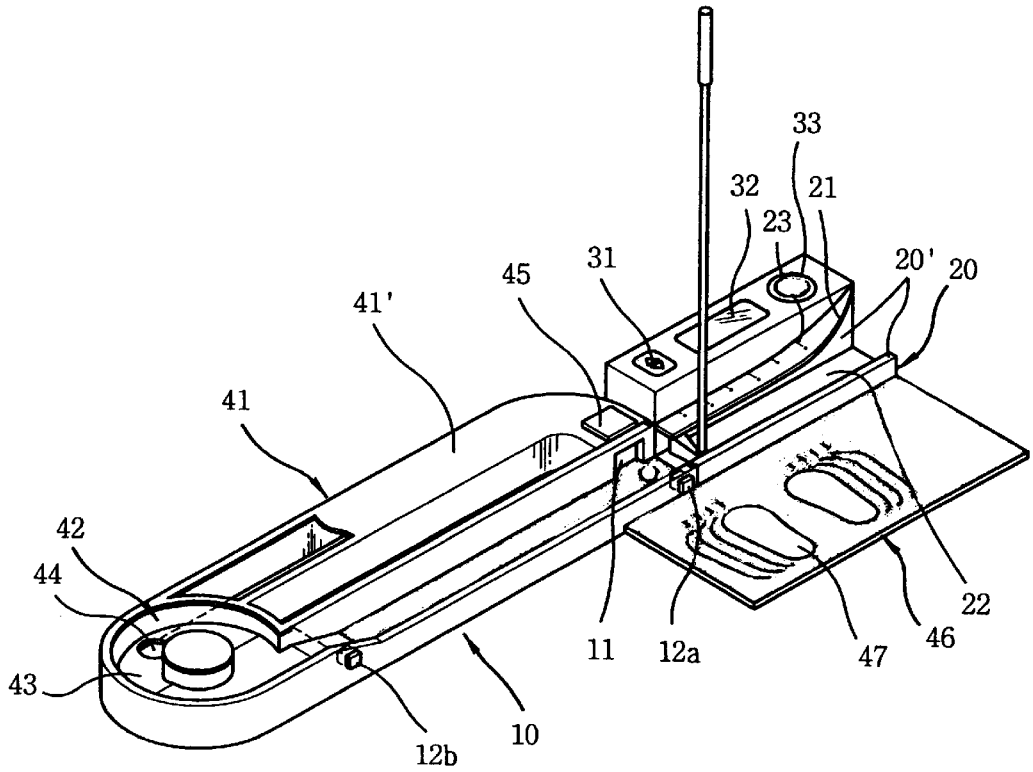
FIG. 5 is a perspective view of a putt-practicing device in accordance with the second embodiment of the present invention.

FIG. 5 is a perspective view of a putt-practicing device in accordance with the second embodiment of the present invention. In the second embodiment of this invention, the putt-practicing device 1 is provided with a ball recovering unit consisting of a ball recovering rail 41 and a ball feed unit 45. The ball recovering rail 41 recovers a putted ball after a putting action, while the ball feed unit 45 is installed at the end of the rail 41 for feeding the recovered ball to the start mark 13 of the first casing 10 of the putt-practicing device 1.

The ball recovering rail 41, having an oval shape and covered with an upper cover 41', provided around the first casing 10 and recovers putted balls. In the ball recovering unit, a ball rotating drum 42 is provided at the second end of the first casing 10, and rotates putted balls so as to reduce the, velocity of the balls, putted with different hitting strengths, and feed the balls to the rail 41. The ball feed unit 45 is a conventional unit, and is provided at the end of the rail 41 at a position around the ball inlet 11 so as to feed the recovered balls to the start mark 13 of the first casing 10 one by one. The ball recovering unit automatically recovers the putted balls, and automatically feeds the recovered balls to the start mark 13 of the first casing 10 one by one, thus being convenient to the users while practicing the putting.

In the ball recovering unit, the ball rotating drum 42 has a cylindrical shape with ball inlet and outlet communicating with the rail 41, thus rotating the putted balls to reduce the velocity of the balls prior to feeding the balls to the rail 41. A slope bottom surface 43 is formed along the channel of the drum 42 such that it is inclined downward from the inlet to the outlet. A hole 44 is formed on the lowermost area of the slope surface 43 and communicates with the rail 41, and so a ball, reduced in its moving velocity due to its rotating action along the channel of the drum 42, is reliably fed into the rail 41.

In the present invention, it is preferable to make the ball rotating drum 42 using a material capable of minimizing the impact energy and impact noises when putted balls come into contact with the drum 42, thus reducing the velocity and impact energy of the putted balls and reducing the impact energy applied from the balls to the rail 41 and reliably feeding the balls to the rail 41. It is most preferable to make the ball rotating drum 42 using rubber.

When a user putts a ball under the condition that the practical backstroke distance of a putter is equal to the target distance displayed on the display window 32, the putted ball is reduced in its moving velocity while being rotated along the channel of the drum 42. The ball with the reduced velocity finally rolls downward along the slope surface 43 to be inserted into the hole 44, thus being fed to the rail 41.

The putt-practicing device according to the second embodiment of this invention is also provided with a foothold 46 at a side of the second casing 20 for allowing a user to form a good stance while putting. A plurality of foot marks 47 are formed on the foothold 46 for allowing a user to repeatedly putt while appropriately changing his/her stance in accordance with a target putting distance, thus allowing the user to practice his/her putting stance in accordance with a desired putting distance.

In addition, the first and second casings 10 and 20 have the locking holes 14 and locking projections 24 at their facing ends. Due to the locking holes 14 and locking projections 24, the first and second casings 10 and 20 are detachably assembled into a single body. When it is desired to move the device 1 or keep the device 1 without using it, the two casings 10 and 20 are separated from each other by removing the locking projections 24 from the locking holes 14. Therefore, it is easy to carry the device 1 or easily keep the device 1 on a limited area, and so the device 1 is very convenient to the users.

As described above, the present invention provides a device for putt-practice, which allows a user to preset a desired putting distance, and senses the backstroke distance of a putter during an act of putting in accordance with the preset putting distance, thus allowing the user to putt with a precise backstroke of the putter. The device also senses the moving velocity of a putted ball during the act of putting to convert the sensed moving velocity into a moving distance of the putted ball prior to informing the user of the moving distance of the ball, thereby allowing the user to practice the putting while appropriately changing his/her putting strength in accordance with target putting distances.

The device also has a foothold at a side thereof, with foot marks provided on the foothold for allowing a user to putt while appropriately changing his/her stance in accordance with a preset target putting distance. This device thus allows the user to practice his/her putting stance in accordance with a desired putting distance.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A device for putt-practice, comprising:

a first casing having a predetermined length and being opened at its opposite ends, with a speed sensor provided at each end of said first casing and a ball inlet formed at one end of the first casing; and a second casing opened at its opposite ends and axially connected to an end of said first casing, with a transparent window provided at an upper portion of the second casing for guiding a backstroke movement of a putter during an act of putting, said second casing also having displaying means for displaying a target putting distance preset by a user, a practical backstroke distance of the putter, and putting results after the act of putting.

2. The device according to claim 1, wherein said transparent window, provided at the upper portion of the second casing, is spaced apart from a bottom surface of the second casing to form a space between the window and the bottom surface of the second casing.

3. The device according to claim 1, wherein said transparent window extends in parallel to a bottom surface of the second casing at its first end part, and is curved upward at its second end part.

4. The device according to claim 1, wherein a plurality of notch-marks, each having a sensor, are formed on said transparent window of the second casing.

5. The device according to claim 1, wherein said displaying means of the second casing comprises:

a distance-setting button allowing the user to preset the target putting distance;

a display window displaying the preset target putting distance and the practical backstroke distance of the putter; and a signal generator comparing the preset target putting distance with the practical backstroke distance, sensing a moving velocity of the putted ball during the act of putting, and converting the sensed moving velocity of the ball into a distance prior to generating a voice signal in the form of cheerful melody or alarm voice to inform the user of the putting results after the act of putting.

6. The device according to claim 1, further comprising a ball recovering unit provided around the first casing for recovering putted balls and consisting of:

a ball recovering rail recovering the putted balls discharged from the first casing;

a ball rotating drum provided at the end of the first casing and connected to a first end of the ball recovering rail, said ball rotating drum rotating the putted balls so as to reduce a velocity of the balls, and feed the balls to said rail; and a ball feed unit provided at a second end of the ball recovering rail for feeding the recovered balls to a start mark of said first casing one by one.

7. The device according to claim 6, wherein said ball rotating drum has a cylindrical shape with a ball inlet and a ball outlet communicating with said ball recovering rail, a slope bottom surface formed in said ball rotating drum such that it is inclined downward from the ball inlet to the ball outlet, and a hole formed on a lowermost area of said slope surf ace to communicate with said ball recovering rail.

8. The device according to claim 1, further comprising a foothold provided at a side of said second casing, with a plurality of foot marks formed on said foothold for allowing the user to change his/her stance in accordance with the target putting distance.

* * * * *